United States Patent [19]

Hollingworth

[11] Patent Number: 4,631,929

[45] Date of Patent: Dec. 30, 1986

[54] CLUTCH IN AND FOR JEWELRY ITEMS

[75] Inventor: Franklin D. Hollingworth, Salt Lake City, Utah

[73] Assignee: Marilyn G. Hollingworth, Salt Lake City, Utah

[21] Appl. No.: 724,891

[22] Filed: Apr. 19, 1985

[51] Int. Cl.[4] ..... A44C 7/00

[52] U.S. Cl. ..... 63/13; 24/91; 24/108; 24/155 C; 24/673

[58] Field of Search ..... 63/12, 13, 29 R; 24/90.5, 91, 108, 155 R, 155 C, 673, 900

[56] References Cited

U.S. PATENT DOCUMENTS

| | | | |
|---|---|---|---|
| 439,457 | 10/1890 | Whittemore et al. | 24/155 C |
| 667,888 | 2/1901 | Morrison | 24/108 UX |
| 867,943 | 10/1907 | Boles | 24/673 |
| 1,341,771 | 6/1920 | Allender | 24/108 X |
| 4,344,240 | 8/1982 | Schiller | 24/108 X |

FOREIGN PATENT DOCUMENTS

| | | | |
|---|---|---|---|
| 73248 | 1/1894 | Fed. Rep. of Germany | 24/108 |
| 867465 | 2/1953 | Fed. Rep. of Germany | 24/108 |
| 3009607 | 3/1980 | Fed. Rep. of Germany | 63/12 |
| 2498900 | 1/1981 | France | 63/12 |
| 86426 | 2/1921 | Switzerland | 24/90.5 |

*Primary Examiner*—F. Barry Shay

*Attorney, Agent, or Firm*—Shaffer, Ralph

[57] ABSTRACT

A clutch for securing together component parts of jewelry such as decorative pins, clasps, earrings, necklaces, brooches, and so forth. The coacting body and pin construction herein has a lost-motion detent, whereby to provide for adjustable attachment to ear lobes, clothing, and so forth, of varying thicknesses. In a preferred embodiment of the invention, the lost-motion effect is constrained by sliding frictional engagement between complete turns of a coil spring provided in said body, and the shank of the pin and the detent effect is maintained simultaneously by a radially inturned end of the spring extending into the annular groove on the shank. The groove is wider than the inturned end, allowing for movement thereof longitudinally of the pin without disengagement.

9 Claims, 3 Drawing Figures

CLUTCH IN AND FOR JEWELRY ITEMS

FIELD OF INVENTION

The present invention relates to jewelry and, more particularly, to a new and improved clutch for jewelry items of varying natures, the clutch being constructed so as to permit an adjustable feature of the clutch so as to accommodate varying sizes or widths of supports with which the clutch and its associated jewelry structure will be associated.

DESCRIPTION OF PRIOR ART

In the past a number of different types of clutches or retention-release mechanisms have been associated with jewelry in its many and varied forms. Heretofore a pin-and-spring combination has been found suitable where very small sizes are concerned, the pin being used for selective insertion and withdrawal in the spring. In certain prior arts forms the spring turns tightly engage the pin so as to frictionally retain the pin in engagement position prior to a positive withdrawal of the pin from the spring by a positive action. This is accomplished by the hand of the user. Another type of pin-and-spring combination includes coil spring structure having opposite inturned ends that frictionally engage the pin as by engagement with a pair of mutually-spaced grooves, the coils of the spring intermediate its ends not engaging the pin. Thus, the inturned ends are used to snap into the grooves of the pin, such grooves being of equivalent diameter or width to the diameter of the spring wire at the inturned ends. Accordingly, in the latter event, a positive detent or releasable lock is supplied as between the inturned ends of the spring and the grooves which are equivalently dimensioned to such inturned ends. Hence, a positive and non-adjustable lock is achieved. Representative U.S. and foreign patents bearing upon this prior art are as follows:

| UNITED STATES | FOREIGN |
|---|---|
| 439,457 | 14725 United Kingdom |
| 867,943 | 70506 Austria |
| 995,744 | 407716 France |
| 1,024,865 | 837328 Fed. Rep. of Germany |
| 1,054,319 | |
| 4,292,715 | |

Thus, the above patents are related to the present invention in the releasable securement of the end portions of jewelry structure, even as by a spring when used in a generic context.

The difficulty in the prior art is that, as relates to pin-groove and spring-end or other locks, there is no provision for accomplishing a releaseably adjustable lock, that is, a lost motion connection, of adjustable nature for accommodating different thicknesses of ear lobes, dress materials, and so forth.

BRIEF DESCRIPTION OF PRESENT INVENTION

In the present invention in its broadest context, the jewelry clutch herein includes a hollow body and a pin having an enlarged protuberance and a shank integral therewith and releaseably insertable in such hollow body; means are used to provide a lost-motion detent between the shank and the hollow body, whereby to accommodate attachment of the clutch to items of varying thicknesses as may be disposed between such hollow body and the protuberance. The body itself may be inserted in or form a part of a jewelry piece, such as an ear-jewel.

In a preferred form of the invention the hollow body comprises a casing having a self-contained spring of coil nature. The coil spring is provided with inturned opposite ends the tips of which are positioned slightly inwardly of the maximum internal diameter of the spring, this for the purpose of, as to one of same, engaging or falling within a particular aligned groove provided on the pin. The reason that both ends of the coil spring are turned in is simply for ease of manufacturing and assembly, so that the manufacturer need not determine which end of the spring has an inturned end in order for the spring to be inserted in the casing. The casing itself is dimpled or otherwise provided with suitable inwardly directed protuberance means for retaining the spring inside.

The pin itself is tapered, and which has a bullet-nose extremity forming a part of a tapered portion of such pin; the tapered portion is integral with a medial cylindrical portion of the pin shaft, the cylindrical portion itself being contiguous with a provided groove. The groove itself would be at least twice, and perhaps many times, the wire diameter of the spring. This is for the purpose of providing in effect a width-wise lost-motion connection so that spring end is releasably received by the groove, whereby slight adjustment will exist for a longitudinal axial displacement of the pin relative to the spring. Accordingly, and by such lost-motion detent as is provided, varying sizes of ear-lobes, dress and coat thicknesses, and so forth, can be accommodated. In a still further preferred embodiment of the invention, the cylindrical portion of the pin will be at least as large as the interior diameter of the spring coils, thereby insuring a friction or interference fit between the coils and such cylindrical portions of the pin. This insures that there will be a slight friction drag as between the pin and spring so that even though there is an adjustment feature between the spring end and the groove, the connection will not wobble back and forth; thus, totally free sliding movement between the pin and spring is somewhat restricted. This will reduce play as between the pin and spring and will prevent a wobbling back and forth of the connection for a particular ear-lobe size encountered.

OBJECTS

Accordingly, a principal object of the present invention is to provide a new and improved clutch for jewelry items.

A further object of the invention is to provide a new and improved clutch, and jewelry items incorporating the same, wherein different widths of ear lobes, and thicknesses of coats, dresses, and other materials can be accommodated as a base attachment means for such jewelry.

A further object is to provide for flexibility of mounting of a jewelry item to a base support of possible varying thicknesses.

An additional object is to provide a pin-spring type of clutch device wherein a lost-motion connection is provided as between the turned-in end of the spring and the widened groove accommodating the same.

BRIEF DESCRIPTION OF DRAWINGS

The present invention may best be understood by reference to the following description, taken in connection with the accompanying drawings in which:

FIG. 1 is shown in exploded view, that is, with the pin removed from but approaching the hollow body of the jewelry piece.

DESCRIPTION OF PREFERRED EMBODIMENTS

Figure 1:
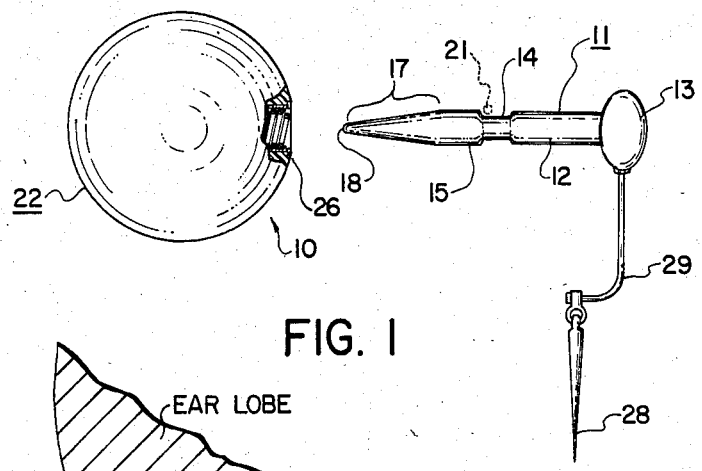
FIG. 1 is a front view of a jewelry item incorporating the principles of the present invention.
Figure 2:
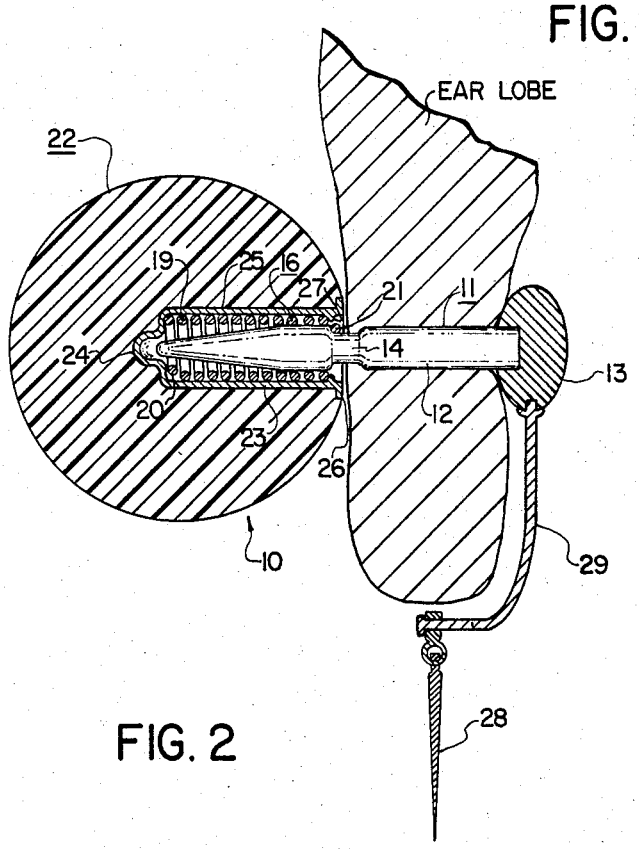
FIG. 2 is an enlarged front view, principally in section, of the structure of FIG. 1 when the same is in releasable engagement position.
Figure 3:
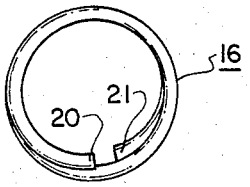
FIG. 3 is an enlarged view of the end of the coil spring utilized in the invention.

In the drawings the clutch 10 is shown to include a pin 11 having shank 12 and, at one end thereof and integral therewith, protuberance 13. A widened recess or groove 14 is supplied and, as will be described hereinafter, forms a lost-motion detent groove. Medial portion 15 is cylindrical, is dimensioned equal to or slightly over-sized relative to the inner diameter of coil spring 16, and in any event is contiguous with extremity tapered portion 17 terminating in a bullet-nosed tip 18.

Spring 16 includes a series of turns or coils 19 and inturned ends 20 and 21. It will be noted that inturned end 20 is totally inoperative and preferably does not engage or restrict the motion of or even frictionally touches any portion of pin 11 during the latter's insertion in the spring. Rather, the sole purpose for a pair of inturned ends, relative to spring 16, is for ease of assembly so that the manufacturer does not have to determine at the outlet which end of the spring has such inturned end.

The axial length of medial cylindrical portion 15 must be such as to engage at least one and preferably four or five of the spring turns, or more, of coil spring 16. The purpose for the inclusion of medial cylindrical portion 15, of equivalent or greater outside diameter than the inside diameter of the spring coils, is to insure a slight frictional engagement or friction drag so as to deter the otherwise free wobbling back and forth of the inturned end 21 relative to groove 14 when the spring and pin are engaged. It is noted that hollow body 22 may take the form of a casing 23 having a forward socket end 24 of reduced dimension and yet able to receive the tapered end of pin 11 for all positions of the latter, that is regardless of where the inturned end 21 of the spring is relative to the enlarged width of groove 14 in which said end is disposed. Socket 24 is contiguous with a cylindrical portion 25, the latter terminating in a radially extending flange 26. If desired, dimples or other means creating inward projections at 27 can be used for retaining the spring in casing 23.

If desired, protuberance 13 may include a wire 29 to which is mounted an ornament 28. Correspondingly, casing 23 may include an outer decorative member such as a simulated pearl (22) in the case of an earring, by way of example. It will be obvious that there are various types of decorative members that can be employed at 22, all of which will either contain an internal depression or recess receiving the spring, or be provided with The casing 23 for hollow body 22 which will be cemented or otherwise secured to decorative member 22 and contain such spring.

In manufacturing and fabrication, it is preferred that the groove 14 in pin 11 be sufficiently deep so that even though inturned end 21, for example, of the coil spring is positioned in the groove, the same will not touch the bottom surface thereof so as to chance to score or mar the same. With such a small diameter relative to the groove, the least tendency for wear at this reduced area of the pin, the better. Rather than relying upon engagement of the inturned end of the spring at the base of the groove, the present invention contemplates a frictional drag taking place as between the medial cylindrical portion 15 of the pin and the interior of at least one and preferably a minor number—to reduce friction drag—of the complete spring turns. Thus, such medial cylindrical portion is preferably designed to be at least equal to and perhaps about 0.0005 inches greater in diameter than the interior of the spring coils. Where there is an exact match as between the medial cylindrical portion and the spring turns, then no space need to be provided as between the exterior of the spring and the interior wall of cylindrical portion 25 of casing 23. However, in the event of an interference fit, that is where there is about a 0.005 greater dimension of medial cylindrical portion 15 relative to the spring turns, then but a slight clearance is needed so as to permit the spring turns to be enlarged slightly as medial cylindrical portion 15 passes there through.

In no event, however, should the inturned end 20 engage the extremity tapered portion 17 of the pin when the latter is thrust home. Tapered portion 17 is preferred so that the drag produced by the spring against the pin during the latter's insertion in the spring will be somewhat reduced, though still adequate to maintain the friction drag needed to avoid free play of the spring end within groove 14. Again, groove 14 will be at least twice the wire size diameter of the spring in width, and perhaps many more times, depending upon the varying widths of ear lobes, for example, experiencing a mounting of the jewelry, as by an earring incorporating the invention and attached to the wearer's ear lobe.

Accordingly, what is provided is a new and useful jewelry clutch that accommodates a variety of thicknesses of ear lobes and/or other materials. This takes the form of the lost-motion detent connection, or rather a releasable connection, as between an inturned end of the spring 16 and the enlarged, widened, lost-motion detent groove of the pin. Scoring of the base of the groove is avoided by keeping the pin end above the groove base; friction drag as may be needed can be supplied by the frictional engagement of medial cylindrical portion 15 with the spring turns at 19.

Tapered extremity portion 17 is ideally suited for pin insertion through the spring such that the bullet-nosed end 18 comes in final disposition within socket 24 of casing 23.

Flange 26 will be useful in securing the hollow body or casing to an externally mounted decorative member, as well as serving as an ear lobe abutment.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A jewelry clutch constructed for adjustable mountings and including, in combination: a hollow body provided with an opening; a coil spring retained in said body in axial alignment with said opening, said coil spring having a series of turns and radially inturned opposite ends; a pin provided with a shank having opposite ends and an enlarged protuberance integral with one of said ends, the remaining end of shank having an extremity tapered portion converging toward said remaining end, said shank including an annular detent groove intermediate said ends, spaced from said protuberance, and said shank being straight and of substantially uniform radius between said groove and said extremity tapered portion, said annular groove being wider than and releasably receiving one of said inturned ends in a lost-motion detent connection, a portion of said shank between said groove and extremity tapered portion slidably frictionally engaging at least one of the complete coil spring turns between said spring ends, when said detent connection is engaged, whereby to restrict free sliding movement of said pin relative to said spring when said detent connection is engaged and yet accommodate adjustable mounting distances between said body and said protuberance.

2. The combination of claim 1 wherein said groove has an annular base radially spaced from that inturned end of said coil spring received by said groove when said detent connection is engaged.

3. The combination of claim 1 wherein said body is a structure of revolution and internally diametrically larger at its major portion than said coil spring, whereby to allow for radial expansion of the spring turns releasably frictionally engaged by said shank of said pin.

4. The structure of claim 1 wherein said extremity tapered portion comprises a bullet-nosed-shaped tip, said body having a reduced end socket receiving said pin remaining end, an annular radially outwardly directed flange portion opposite said reduced end socket, and inwardly directed projection means for retaining said coil spring within said body.

5. The structure of claim 1 wherein said shank is dimensioned to receive ear lobes of varying widths between said body and said protuberances, said pin and hollow body comprising an earring.

6. The combination of claim 1 wherein said extremity tapered portion of said shank freely spacedly passes the remaining one of said inturned spring ends, when said detent connection is engaged.

7. The combination of claim 1 wherein said body is cylindrically formed, having a reduced end socket receiving said pin remaining end, an annular radially outwardly directed flange portion opposite said reduced end socket, and inwardly directed protuberance means for retaining said coil spring within said body.

8. The structure of claim 7 wherein said body comprises a decorative member provided with a secured body insert comprising: an element cylindrically formed and having a reduced end socket receiving said pin remaining end, an annular radially outwardly directed flange portion opposite said reduced end socket, and inwardly directed protuberance means for retaining said coil spring within said element.

9. The structure of claim 8 wherein a decorative ornament is integral with and suspended from said protuberance.

* * * * *